US010316539B2

(12) United States Patent
Lupton

(10) Patent No.: US 10,316,539 B2
(45) Date of Patent: Jun. 11, 2019

(54) REINFORCED POLE FOR A SWIMMING POOL SAFETY BARRIER FENCE

(71) Applicant: Eric Lupton, Delray Beach, FL (US)

(72) Inventor: Eric Lupton, Delray Beach, FL (US)

( * ) Notice: Subject to any disclaimer, the term of this patent is extended or adjusted under 35 U.S.C. 154(b) by 633 days.

(21) Appl. No.: 15/007,943

(22) Filed: Jan. 27, 2016

(65) Prior Publication Data

US 2017/0211290 A1 Jul. 27, 2017

(51) Int. Cl.

| | |
|---|---|
| ***E04H 12/22*** | (2006.01) |
| ***E04H 17/16*** | (2006.01) |
| ***E04H 17/22*** | (2006.01) |
| ***E04H 4/06*** | (2006.01) |

(52) U.S. Cl.

CPC ..... *E04H 12/2292* (2013.01); *E04H 4/06* (2013.01); *E04H 12/2269* (2013.01); *E04H 12/2276* (2013.01); *E04H 17/161* (2013.01); *E04H 17/22* (2013.01)

(58) Field of Classification Search

CPC ..... E04H 17/08; E04H 17/22

See application file for complete search history.

(56) References Cited

U.S. PATENT DOCUMENTS 4,380,327 A * 4/1983 Fish ..... E04H 17/06 256/24
4,576,364 A * 3/1986 O'Fearna ..... E04H 15/003 256/23
5,152,508 A * 10/1992 Fish ..... E04H 4/06 256/24
5,471,809 A * 12/1995 Frankel ..... E04C 3/29 138/114
5,553,833 A * 9/1996 Bohen ..... E01F 13/026 256/19
5,862,642 A * 1/1999 Erwin ..... E04H 17/1413 256/19
7,500,654 B2 * 3/2009 Rosaen ..... E04H 12/2215 248/545
7,530,550 B2 * 5/2009 Fattori ..... E04F 11/1812 256/65.05
8,615,964 B1 * 12/2013 Poma ..... E04F 11/1812 256/59
2005/0109998 A1 * 5/2005 Sadinsky ..... E04H 4/06 256/25
2005/0116213 A1 * 6/2005 Dahowski ..... E04H 17/161 256/24
2008/0272353 A1 * 11/2008 Fattori ..... E04F 11/1812 256/19

* cited by examiner

*Primary Examiner* — Matthieu F Setliff
(74) *Attorney, Agent, or Firm* — Robert M. Downey, P.A.

(57) ABSTRACT

A reinforced pole structure used in the construction of a swimming pool safety barrier fence having flexible, light-weight mesh panels attached to a spaced arrangement of vertically oriented metal poles, wherein a lower end portion of each pole is fitted within a mounting receptacle in the deck. Each pole includes a bendable reinforcement insert fixed within a hollow interior of the pole at a lower end zone extending from a bottom end of the pole and beyond the lower end portion. The reinforcement insert includes a PVC pipe section with a solid core. In the event a metal pole breaks at the lower end zone as a result of an external force applied thereto, the reinforcement insert can be bent back straight, thereby allowing the pole to be used functionally until replaced with a new pole.

10 Claims, 4 Drawing Sheets

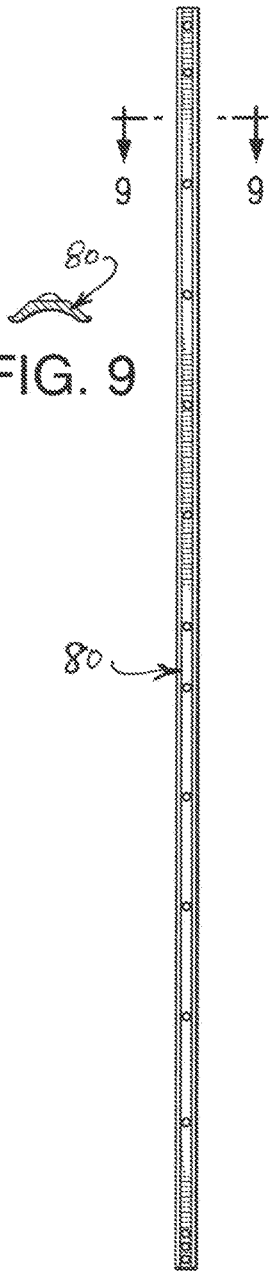
FIG. 9
FIG. 8
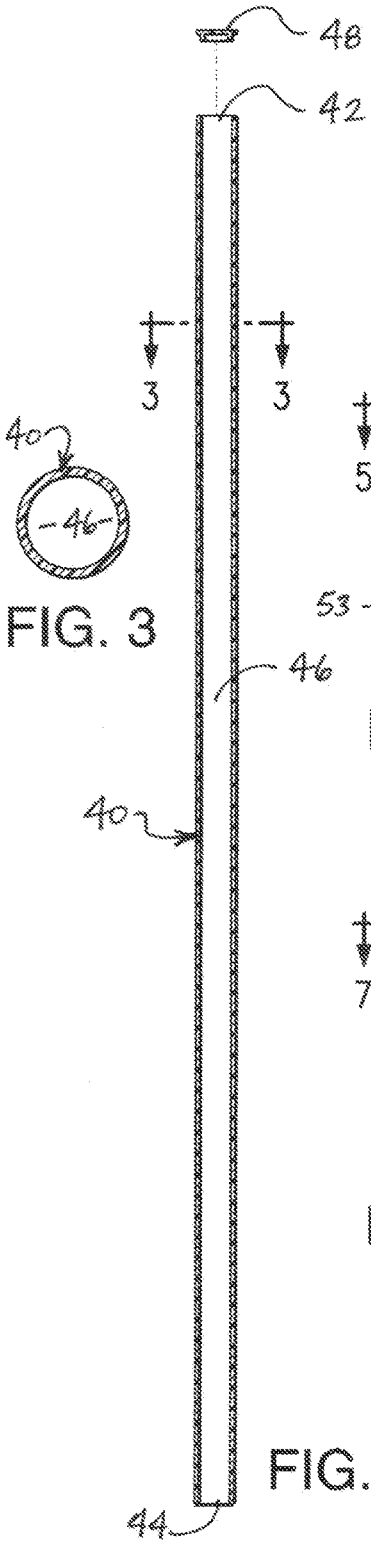
FIG. 2
FIG. 3
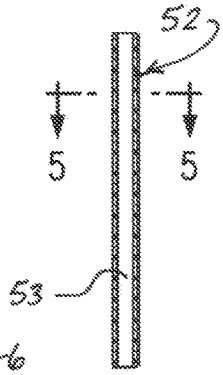
FIG. 4
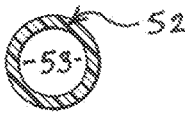
FIG. 5
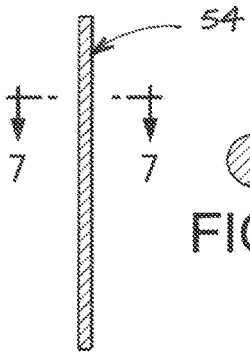
FIG. 6
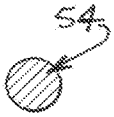
FIG. 7

REINFORCED POLE FOR A SWIMMING POOL SAFETY BARRIER FENCE

BACKGROUND OF THE INVENTION

Field of the Invention

The present invention relates to swimming pool safety barrier fences having flexible, lightweight mesh panels clamped to poles that are slid into mounting receptacles in a deck, and more particularly to a reinforced pole structure having a bendable insert in a lower section that can be straightened in the event the pole is broken as a result of external forces exerted on the erected swimming pool safety barrier fence, thereby allowing for continued use of the broken pole until it can be replaced.

Discussion of the Related Art

Drowning is the leading cause of accidental death of children up to four years of age and is the second-leading cause of unintentional injury-related death of children between the ages of four and fourteen. Most of these drownings occur in residential swimming pools. In response to this serious and devastating problem, various systems, devices and apparatus have been developed in the art to help protect young children from accidental pool drownings. One of the most popular and effective measures against accidental drowning is to erect a safety barrier fence around the entire perimeter of the swimming pool so that young children are not able to access the pool without adult supervision.

Well known safety barriers that are commonly installed around residential swimming pools include stretched-panel fences that have flexible lightweight nylon mesh panels pulled taut and clamped to vertically oriented aluminum poles that are spaced every 3-4 feet. A lower portion of the poles extends below a bottom edge of the fence panels for insertion into the deck surrounding the pool. More specifically, holes are drilled into the pool deck and spaced slightly further apart than the distance between the poles. Next, mounting receptacles (i.e., plastic sleeves) are pounded into the drilled holes so that the top end of the receptacles is generally flush with the pool deck surface. The lower end portions of the poles (typically four to six inches from the bottom end of each pole) are then inserted into a respective mounting receptacle, causing the fence panels to be stretched due to the spacing of the mounting receptacles. Examples of this type of safety barrier pool fence are found in U.S. Pat. Nos. 4,380,327 and 5,553,833.

One common problem that occurs with the above-described swimming pool safety barrier fences is bending and cracking of the poles, particularly near the lower end portion. This can happen if an adult or heavy object accidentally falls against the erected fence. In this instance, the force against the fence causes the fence, including the poles, to lean while the lower end portion of the poles remain anchored and upright within the mounting receptacles. Yielding to the force, the poles bend and crack in the area just above the mounting receptacles. Once broken, it is necessary to replace the damaged poles. This entails a costly and time consuming process of removing the broken poles from the flexible mesh fence panels and attaching new poles in the exact location on the fence panel.

Considering the common and ongoing problem of safety barrier fence poles bending and breaking, as described above, there remains a definite and urgent need for a reinforced pole structure for swimming pool safety barrier fences that will withstand significant force (e.g., the weight of an average adult) exerted against the erected pool fence panels while allowing the lower section of the poles to be straightened after being bent so that they can continue to be used functionally until replaced with a new pole.

SUMMARY OF THE INVENTION

The present invention is directed to a reinforced pole structure for use in the construction of a swimming pool safety barrier fence of the type having flexible, lightweight nylon mesh panels that are attached to a spaced arrangement of vertically oriented metal poles. More specifically, a section of fence is constructed by attaching a horizontal length of flexible, lightweight nylon mesh to two or more spaced apart poles. The mesh material, forming the fence panels, is attached to the poles with the use of a cove moulding that is secured to the pole with screws to effectively clamp the mesh material between the cove moulding and the pole. A lower end portion of each pole, extending below a bottom edge of the fence panels is inserted within a mounting receptacle (e.g., plastic sleeve) fitted within the pool deck.

Reinforcement of the poles, in accordance with the present invention, is achieved with the use of a bendable reinforcement insert that is fitted within the hollow interior of each metal pole at the lower end portion. More specifically, the reinforcement insert is received through an open bottom end of each pole and extends from the bottom end to a location above the lower end zone (i.e., above the bottom edge of the fence panel that is attached to the pole). The reinforcement insert includes a section of PVC pipe that has an outer diameter generally equal to an inner diameter of the hollow metal pole to allow a tight friction fit of the reinforcement insert within the pole. The reinforcement insert further includes a solid bendable rod of equal length to the PVC pipe section. The rod is fitted within the hollow interior of the PVC pipe section, providing a solid core, and has an outer diameter that is generally equal to an inner diameter of the PVC pipe section, to thereby provide a tight friction fit. Fixed attachment of the solid rod within the PVC pipe section may also be achieved with the use of a bonding material such as a noncorrosive silicon adhesive. When properly installed, the reinforcement insert extends from the bottom end of each pole to a location that is above the bottom edge of the fence so that the reinforcement insert extends beyond the location where the pole exits the mounting receptacle, which is the area of the pole which is most susceptible to bending and breaking.

Objects and Advantages of the Invention

Considering the foregoing, it is a primary object of the present invention to provide a reinforced pole structure for use in the construction of a swimming pool safety barrier fence that significantly increases resistance against bending of the fence poles when the safety barrier fence is erected with the lower end portions of the poles anchored within mounting receptacles in the deck.

It is a further object of the present invention to provide a reinforced pole structure for swimming pool safety barrier fences including a bendable insert that allows a bent and broken pole to be straightened and reused until it can be replaced with a new pole.

It is a further object of the present invention to provide a reinforced pole structure for swimming pool safety barrier fences that is easily adapted, by retro-fit, to existing poles commonly used in the construction of swimming pool safety barrier fences.

It is still a further object of the present invention to provide a reinforced pole structure for use in the construction of swimming pool safety barrier fences that is resistant to corrosion.

It is still a further object of the present invention to provide a reinforced pole structure for use in the construction of swimming pool safety barrier fences that is relatively inexpensive and does not significantly increase the cost of construction of the safety barrier fence.

It is yet a further object of the present invention to provide a reinforcement insert for poles used in the construction of swimming pool safety barrier fences, and wherein the reinforcement insert can be easily and quickly installed within the interior of an existing aluminum pole and held in place by friction without the need for additional fastening hardware.

It is still a further object of the present invention to provide a reinforced pole structure for use in the construction of swimming pool safety barrier fences that can be easily implemented and adapted to existing manufacturing procedures.

These and other objects and advantages of the present invention are more readily apparent with reference to the detailed description and accompanying drawings.

BRIEF DESCRIPTION OF THE DRAWINGS

For a fuller understanding of the nature of the present invention, reference should be made to the following detailed description taken in conjunction with the accompanying drawings in which:

FIG. 2 is an elevational view, shown in cross-section, of a metal pole component and top cap in accordance with the present invention;

FIG. 3 is an enlarged transverse cross-sectional view of the metal pole of FIG. 2 taken along the plane indicated by the arrows 3-3 in FIG. 2;

FIG. 4 is a longitudinal cross-sectional view of a PVC pipe component of the present invention;

FIG. 5 is an enlarged transverse cross-sectional view taken along the plane indicated by the arrows 5-5 in FIG. 4;

FIG. 6 is a longitudinal cross-sectional view of a solid metal rod component of the present invention;

FIG. 7 is an enlarged transverse cross-sectional view taken along the plane of the line indicated by the arrows 7-7 in FIG. 6;

FIG. 8 is an elevational view of a cove moulding component of the invention;

FIG. 9 is a transverse cross-sectional view of the cove moulding taken along the plane of the line indicated by the arrows 9-9 in FIG. 8;

Like reference numerals refer to like parts throughout the several views of the drawings.

DETAILED DESCRIPTION OF THE PREFERRED EMBODIMENT

Figure 1:
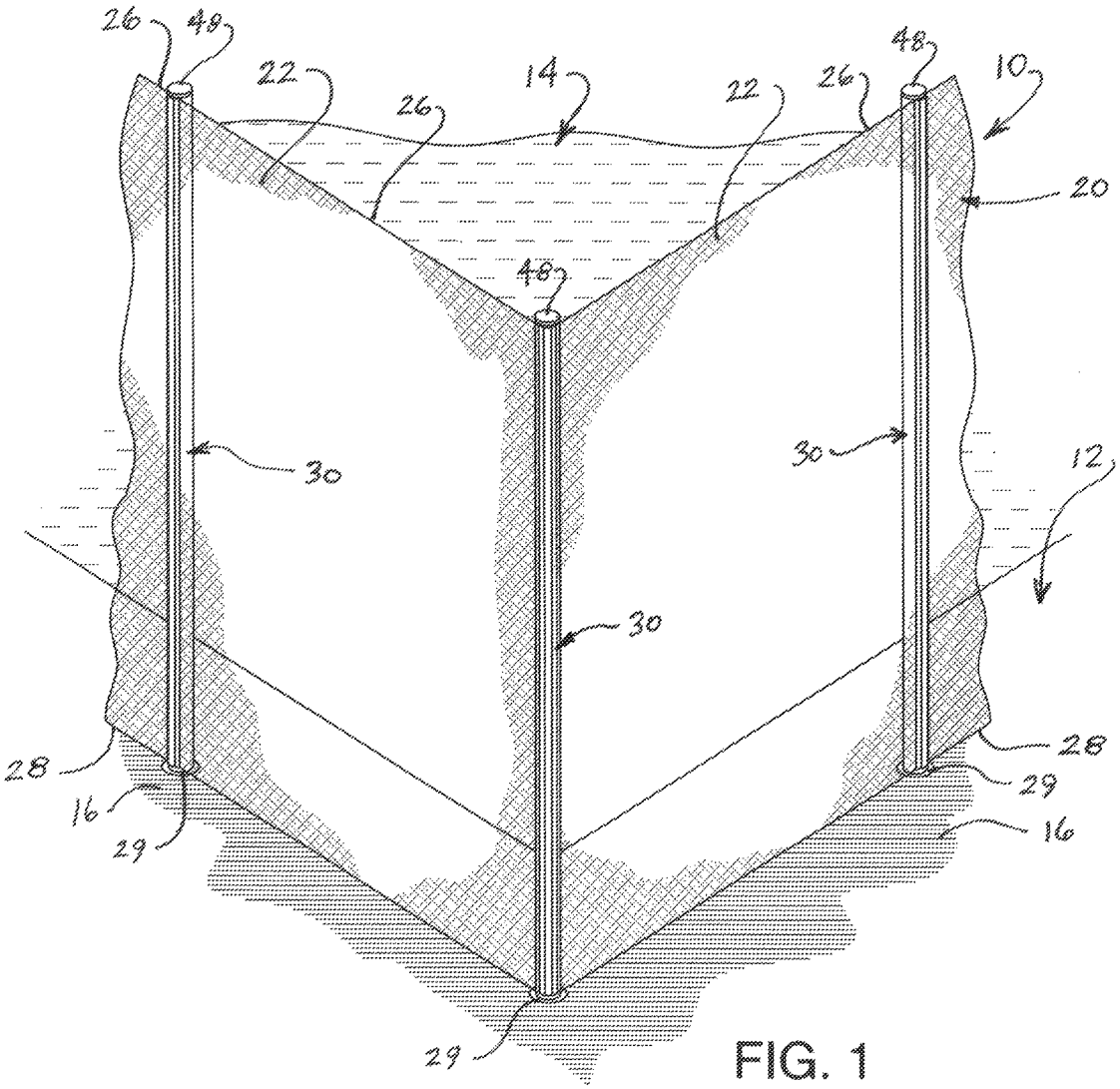
FIG. 1 is an isolated perspective view of a section of a swimming pool safety barrier fence installed in a deck surrounding a swimming pool.

Referring initially to FIG. 1, a safety barrier fence assembly 10 is shown installed to a pool deck 12 surrounding a swimming pool 14. The safety barrier fence assembly 10 includes a flexible, lightweight mesh material 20 attached and extending between a spaced arrangement of vertically oriented reinforced metal poles 30 to define fence panels 22 between the reinforced poles 30. As seen in FIG. 1, a top edge 26 of the fence panels is positioned just below a top end of each pole, extending horizontally therebetween. A bottom edge 28 of each of the fence panels 24 extends horizontally between the spaced apart poles 30 and is positioned at or just above the deck surface 16. A lower end zone of each pole 30 is received within a mounting sleeve 29 fitted within a hole or bore that has been previously drilled into the deck (as seen in FIG. 11).

The reinforced pole 30 includes an assembly of a number of components as shown throughout the drawing figures. Specifically, the reinforced pole 30 includes a primary pole member 40 defined by an elongate metal pole or tube (see FIG. 2). The primary pole member 40 includes an open top end 42, an open bottom end 44 and a hollow interior 46 extending between the open top and bottom ends. A cap 48 is fitted onto the open top end, to cover the top end and prevent entry of water into the hollow interior. In a preferred embodiment, the primary pole member 40 is an aluminum pole having a one inch diameter and a length of approximately 54 inches.

Figure 11:
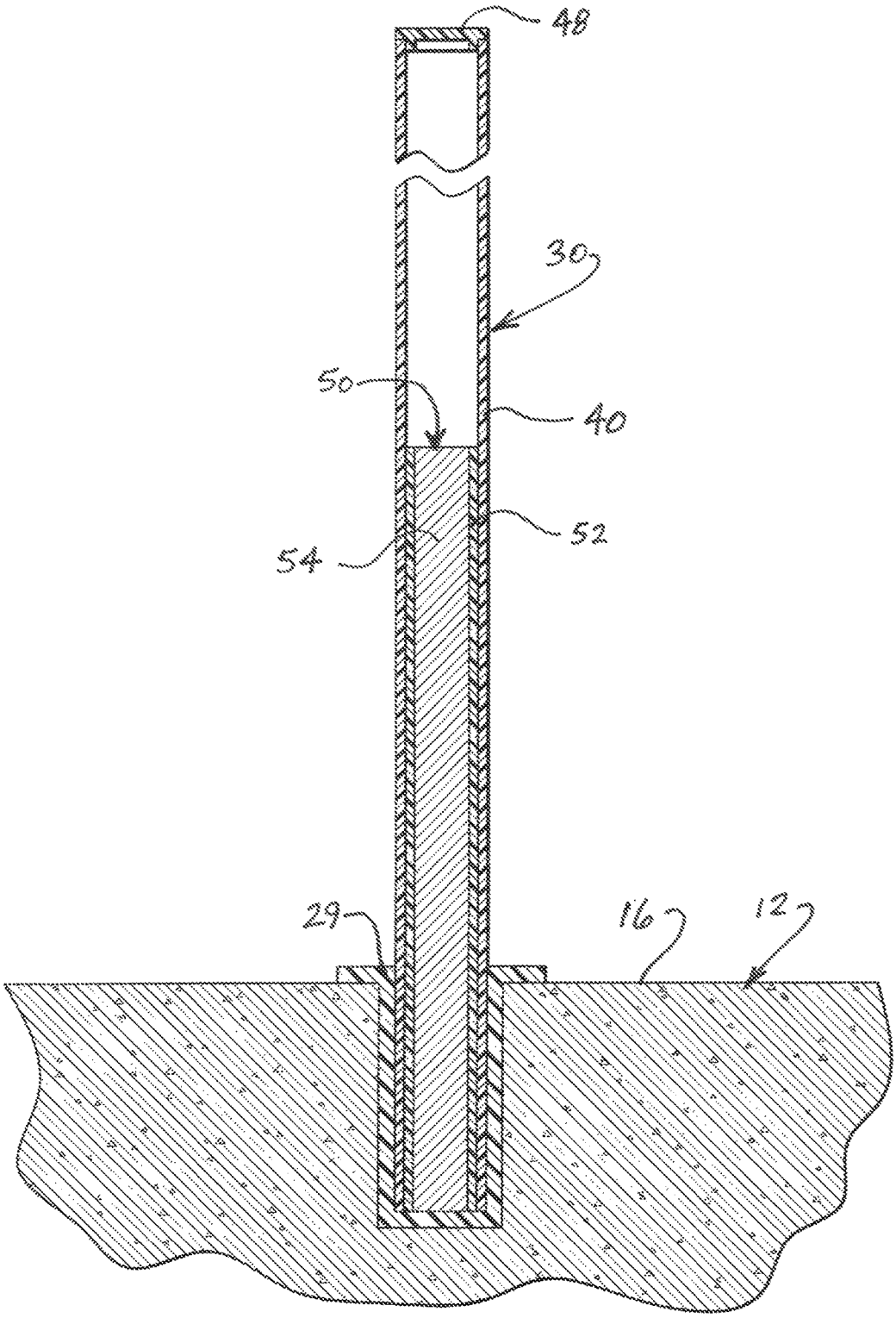
FIG. 11 is a vertical cross-sectional view of the reinforced pole structure of the present invention installed within a receptacle within a concrete deck.

FIGS. 4-7 illustrate the components of a bendable reinforcement insert 50 that is fitted through the open bottom end 44 of the primary pole member 40 so that the reinforcement insert extends from the open bottom end and filling the hollow interior 46 of the primary pole member 40 up to a location that is above the deck surface when the lower end portion of the pole 30 is received within the mounting receptacle, as seen in FIG. 11. In a preferred embodiment, the lower end portion of the pole 30 is approximately 3-4 inches in length and is received within the mounting receptacle. The reinforcement insert has a length of between 8 inches and 14 inches. In a preferred embodiment, the reinforcement insert is approximately 12.5 inches in length so that the reinforcement insert extends approximately 8½-9½ inches above the deck surface 16 when the pole 30 is properly installed and fitted within the mounting receptacle with the safety barrier fence properly erected, as shown in FIG. 1.

The bendable reinforcement insert 50 includes a PVC pipe section 52 that has a hollow interior 53. In a preferred embodiment, the PVC pipe section 52 is schedule 80 and has an outer diameter of ⅞ inches. The bendable reinforcement insert 50 further includes a solid rod 54 that is fitted within the hollow interior 53 of the PVC pipe section 52 to provide a solid core. In a preferred embodiment, the solid rod 54 is formed of a metal material and has an outer diameter of approximately ½ inch and the hollow interior 53 of the PVC pipe section 52 has an inner diameter that is approximately equal to the outer diameter of the solid metal rod 54, so that the solid metal rod is tightly fitted within the interior of the PVC pipe section. Moreover, the primary pole member 40 preferably has an inner diameter that is approximately equal to the outer diameter of the PVC pipe section so that the reinforcement insert 50 is tightly fitted within the hollow interior 46 of the primary pole member 40 and held in place by friction between the outer surface of the PVC pipe section 52 and the inner surface of the primary pole member 40. The solid rod 54 can be formed of any suitable rigid material that can bend under significant force, but which will resist cracking and breaking. In one embodiment, the solid rod 54 is formed of aluminum.

Figure 10:
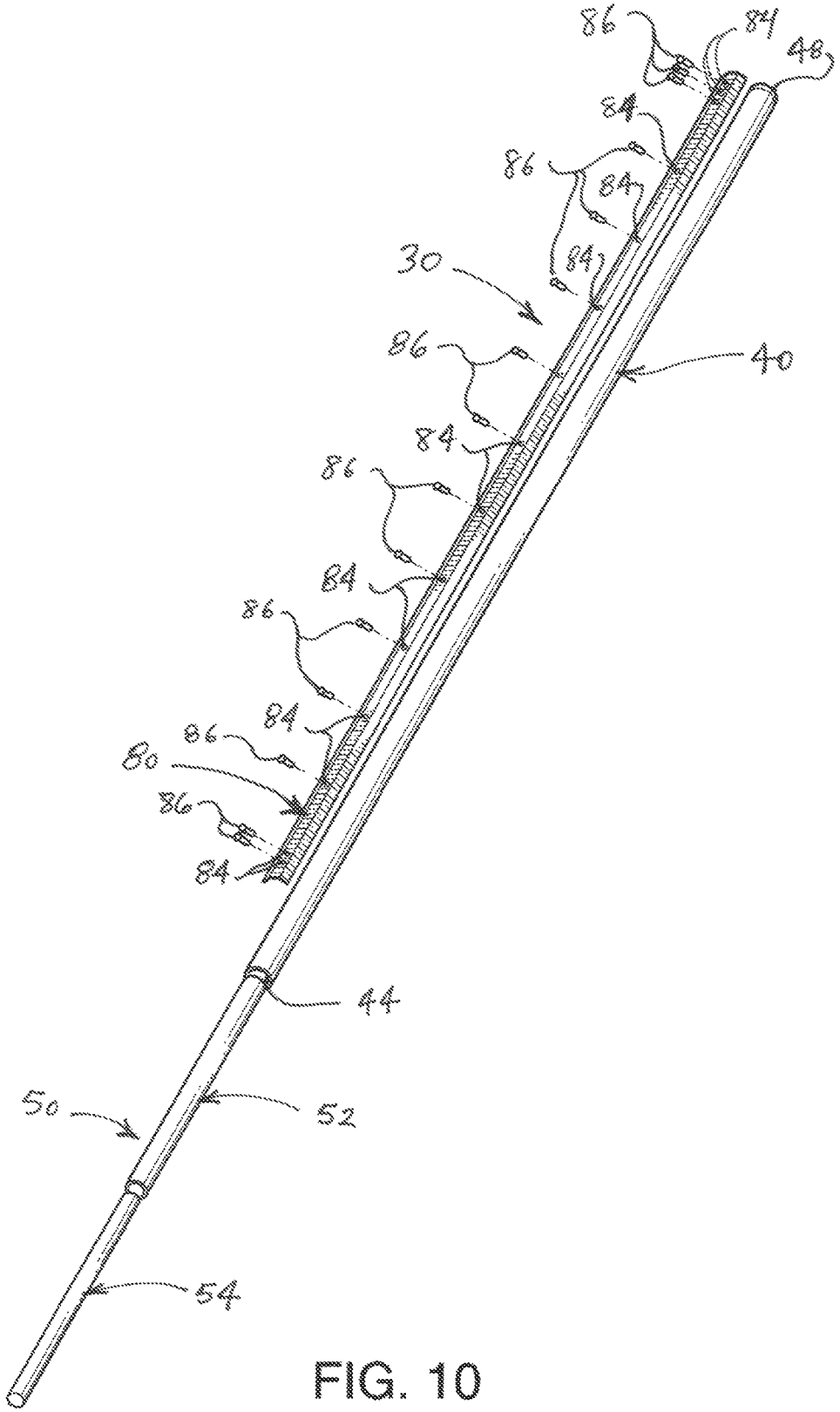
FIG. 10 is an exploded perspective view illustrating the assembly of the several components of the reinforced pole structure of the present invention.

Referring to FIGS. 8-10, the flexible lightweight mesh fence panel material 20 is attached to the outer surface of each primary pole member 40 with the use of a cove moulding 80 that extends from a location just below the top end of the primary pole member 40 and down to the beginning of the lower end portion which is at the location where the bottom edge of the fence panels attach to the poles. The cove moulding 80 is attached to a primary pole member 40, with the mesh fence panel material 20 sandwiched therebetween. More specifically, the cove moulding 80 is provided with an arrangement of spaced holes 84 for receiving screws 86 that extend through the cove moulding 80, the mesh fence material 20 and into the primary pole member 40. In a preferred embodiment, the screws 86 are ½ inch stainless steel pan head screws. The shape of the cove moulding 80 allows it to partially wrap around the outer surface of the primary pole member 40, effectively clamping the mesh material 20 to the outer surface of the primary pole member 40. In one embodiment, the cove moulding 80 is formed of aluminum.

What is claimed is:

1. A safety barrier fence for installation to a deck, said assembly comprising:

at least two poles each including a primary pole member having an open top end, an open bottom end and a hollow interior between the open top and bottom ends;

a flexible mesh material attached to each primary pole member of the at least two poles and spanning between the at least two poles to define a fence panel having a top horizontal edge and a bottom horizontal edge;

each primary pole member having a lower end zone extending below the bottom horizontal edge of the fence panel and being structured and disposed for receipt into the deck and below the top surface of the deck;

a reinforcement insert fitted within the hollow interior of each primary pole member for adding strength to the primary pole member, and the reinforcement insert having a bottom end terminating at or above the open bottom end of the primary pole member, and the reinforcement insert extending upwardly within the hollow interior and having a top end terminating above the lower end zone so that when the lower end zone of the primary pole member is received into the deck with the safety barrier fence installed and erected, the reinforcement insert extends above the deck surface; and the reinforcement insert including a section of pipe formed of a synthetic plastic polymer, and a solid metal bar fitted within the section of pipe to provide a solid core.

2. The assembly as recited in claim 1 wherein the reinforcement insert has a length of between 8 inches and 14 inches.

3. The assembly as recited in claim 1 wherein the section of pipe is formed of polyvinyl chloride.

4. The assembly as recited in claim 1 wherein the solid metal bar is aluminum.

5. The assembly as recited in claim 1 wherein the primary pole member is metal.

6. A safety barrier fence for installation to a deck, said assembly comprising:

at least two poles each including a primary pole member having an open top end, an open bottom end and a hollow interior between the open top and bottom ends, and the primary pole member including an inner diameter;

a flexible mesh material attached to each primary pole member of the at least two poles and spanning between the at least two poles to define a fence panel having a top horizontal edge and a bottom horizontal edge;

each primary pole member having a lower end zone extending below the bottom horizontal edge of the fence panel and being structured and disposed for receipt into the deck and below the top surface of the deck;

a reinforcement insert fitted within the hollow interior of each primary pole member for adding strength to the primary pole member, the reinforcement insert having an outer diameter that is sized relative to the inner diameter of the primary pole member to allow for snug fitted frictional engagement of the reinforcement insert within the hollow interior of the primary pole member to hold the reinforcement insert in fixed position within the primary pole member, and the reinforcement insert having a bottom end terminating at or above the open bottom end of the primary pole member, and the reinforcement insert extending upwardly within the hollow interior and the reinforcement insert having a top end terminating above the lower end zone so that when the lower end zone of the primary pole member is received into the deck with the safety barrier fence installed and erected, the reinforcement insert extends above the deck surface; and the reinforcement insert including a section of pipe formed of a synthetic plastic polymer, and a solid metal bar fitted within the section of pipe to provide a solid core.

7. The assembly as recited in claim 6 wherein the reinforcement insert is structured and disposed to bend in response to external bending forces applied to the primary pole member, and the reinforcement insert being further structured and disposed to be straightened from a bent configuration in response to an external straightening force applied thereto.

8. The assembly as recited in claim 7 wherein the reinforcement insert has a length of between 8 inches and 14 inches.

9. The assembly as recited in claim 7 wherein the section of pipe is formed of polyvinyl chloride.

10. The assembly as recited in claim 7 wherein the solid metal bar is aluminum.

* * * * *